US006377033B2

(12) United States Patent
Hsu

(10) Patent No.: US 6,377,033 B2
(45) Date of Patent: Apr. 23, 2002

(54) LINEAR REGULATOR CAPABLE OF SINKING CURRENT

(75) Inventor: Hui-Te Hsu, Shindian City (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 09/911,499

(22) Filed: Jul. 25, 2001

(30) Foreign Application Priority Data

Aug. 7, 2000 (TW) ..... 89115893 A

(51) Int. Cl.[7] ..... G05F 1/565

(52) U.S. Cl. ..... 323/274; 323/276; 323/280

(58) Field of Search ..... 323/273, 274, 323/275, 276, 279, 280, 281

(56) References Cited

U.S. PATENT DOCUMENTS

| | | | | |
|---|---|---|---|---|
| 5,864,227 | A | 1/1999 | Borden et al. | 323/280 |
| 5,982,226 | A | 11/1999 | Rincon-Mora | 323/273 X |
| 6,201,375 | B1 | 3/2001 | Larson et al. | 323/280 X |

*Primary Examiner*—Jessica Han
(74) *Attorney, Agent, or Firm*—Rabin & Berdo, P.C.

(57) ABSTRACT

A linear regulator capable of sinking current. The linear regulator has an output terminal, providing the next stage with an output voltage. The next stage may feed the linear regulator with current. The linear regulator includes a first transistor, a first amplifier, a second transistor, and a second amplifier. When the output voltage at the output terminal is greater than a certain value, the second transistor conducts and sinks the current from the next stage. The linear regulator according to the invention can handle the problem of the feeding current from the next stage, making the output voltage under the restricted range of the linear regulator.

10 Claims, 5 Drawing Sheets

LINEAR REGULATOR CAPABLE OF SINKING CURRENT

This application incorporates by reference Taiwanese application Ser. No. 89115893, filed on Aug. $7^{th}$, 2000.

BACKGROUND OF THE INVENTION

1. Field of the Invention

The invention relates in general to a linear regulator, and more particularly to a linear regulator which is capable of sinking current and suitable to be employed as the previous stage of a circuitry that may feed the previous stage with current.

2. Description of the Related Art

Referring to FIG. 1A, it illustrates a conventional linear regulator for outputting a fixed and stable output voltage Vout. An amplifier 102 receives a reference voltage Vref of positive value at the amplifier's non-inverting input terminal, and the inverting input terminal of the amplifier 102 is connected to node N1. Node N1 is also the common terminal of the resistors R1 and R2 in series, and the resistor R2 is further connected to the ground GND. Finally, the output terminal of the amplifier 102 is connected to the base B1 of transistor Q1. The collector C of the transistor Q1 is used to receive an input voltage Vin while the emitter E1 of the transistor Q1 is connected to the resistor R1 and capacitor C. In addition, the emitter E1 is used to output an output voltage Vout.

Referring to FIG. 1B, it illustrates the linear regulator in FIG.1 terminated with a circuitry 104, the next stage of the linear regulator. An example of circuitry 104 is the input stage of a double data rate random access memory (DDR RAM). The circuitry 104 has two switching operating modes. Specifically, the circuitry 104 can be regard as an equivalent input resistor Rin connecting to the ground or a fixed voltage V1 through an equivalent switch 106. The fixed voltage V1 may be from the data bus of the DDR RAM. When the input resistor Rin is connected to the ground, the operations of the linear regulator in FIG.1 is as follows. Firstly, when the linear regulator is initialized, the output voltage Vout from the output terminal 100 is zero. Thus, the output of the amplifier 102 is a positive voltage so the transistor Q1 conducts and the capacitor C is charged. In addition, the current flows through the resistor Rin.

Besides, when the Rin is connected to the fixed voltage V1 by the switch 106, there exists a current flowing through the Rin and back to the output terminal 100, leading to the capacitor C to be charged. The voltage of capacitor C then continues to increase, finally exceeding the limitation of the system. Since the conventional linear regulator only outputs current to the next stage, or the circuitry 104, but cannot sink the feeding current from the next stage, if the circuitry 104 feeds the previous stage with the current, it may cause the conventional linear regulator not to be able to operate in the operation modes as usual.

The conventional approach to the problem of feeding current from the next stage is using a circuitry as shown in FIG. 2. In FIG. 2, a controller 202 is used to detect the voltage of a node N2 and turns on or off the transistor Qa and Qb in responsive to the voltage of the node N2, where the voltage of the node N2 corresponds to the output voltage Vout at the output terminal 204. Like the example in FIG. 1, the output terminal 204 is connected to the next stage, circuitry 206. When the circuitry 206 feeds the linear regulator with current so that the output voltage Vout increases, the controller 202 turns on the transistor Qb, lowering the output voltage Vout.

However, the speed of switching on the transistor Qb controlled by the controller 202 is restricted since the inductance L in FIG. 2 limits the feeding current from the next stage. Therefore, during the output voltage Vout increasing but the transistor Qb not conducting, in order to prevent the output voltage Vout from exceeding, a capacitor Ca of high capacitance is used to absorb the unnecessary energy from the next stage. In this case, the energy stored in the inductance L is then transferred to the capacitor Ca, affecting the output voltage Vout. Consequently, for lowering the effect of the inductance L on the capacitor Ca, the capacitance of Ca has to be higher. Besides, since large changes in current per unit time occur in the capacitor Ca, a capacitor of high quality and high expense has to be employed as the capacitor Ca. This is because that a high quality capacitor Ca has its equivalent serial inductance and resistor in small values so that the output voltage Vout is prevented from increasing as the current flows through the capacitor Ca.

Thus, the capacitor of high quality and large capacitance has to be used in the conventional linear regulator in FIG. 2, leading to the increase in the production cost. Besides, in order to provide good performance, the controller 202 employed in the circuitry of FIG. 2 has to be accurate in controlling capability. Therefore, it further greatly increases the cost of implementation of the circuitry and hence limits the circuitry's usage.

SUMMARY OF THE INVENTION

It is therefore an object of the invention to provide a linear regulator capable of sinking current. When the output of the next stage of the linear regulator according to the invention changes to a fixed voltage, the linear regulator handles the feeding current from the next stage, resulting in an output voltage restricted within a range under the system limitations. According to the invention, a simple structure of circuitry with only a small number of components is necessary to achieve the identical purpose of the conventional linear regulator for resolving the feeding current from the next stage. Besides, no inductance is employed in the circuitry so that the switching speed, in responsive to the feeding current from the next stage, for handling the problem is rapid. In this way, the linear regulator according to the invention provides a better performance and requires a less production cost, having the advantages over other products.

In accordance with the object of the invention, it provides a linear regulator capable of sinking current, outputting an output voltage at an output terminal of the linear regulator. The output terminal provides a next stage with the output voltage while the next stage feeds the linear regulator with current. The linear regulator includes a first transistor, a second transistor, a first amplifier, and a second amplifier. The first transistor, which is connected to the output terminal of the linear regulator, is used for receiving an input voltage. The first amplifier has a first non-inverting input terminal, a first inverting input terminal, and a first output terminal. The first non-inverting input terminal is used for receiving a first reference voltage. The first output terminal, which is connected to the first transistor, is used for controlling the first transistor. The first inverting input terminal is used for receiving a first voltage that corresponds to the output voltage. The second transistor is connected to the output terminal of the linear regulator. The second amplifier has a second non-inverting input terminal, a second inverting input terminal, and a second output terminal. The second non-inverting input terminal is used for receiving a second voltage that corresponds to the output voltage. The second inverting input terminal is used for receiving a second reference voltage, where the second reference voltage is greater than the first reference voltage. The second output terminal, which is connected to the second transistor, is used for controlling the second transistor. When the second voltage is greater than the second reference voltage, the second transistor conducts and sinks the current from the next stage.

In addition, the next stage can be the input stage of a double data rate random access memory (DDR RAM).

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 3:
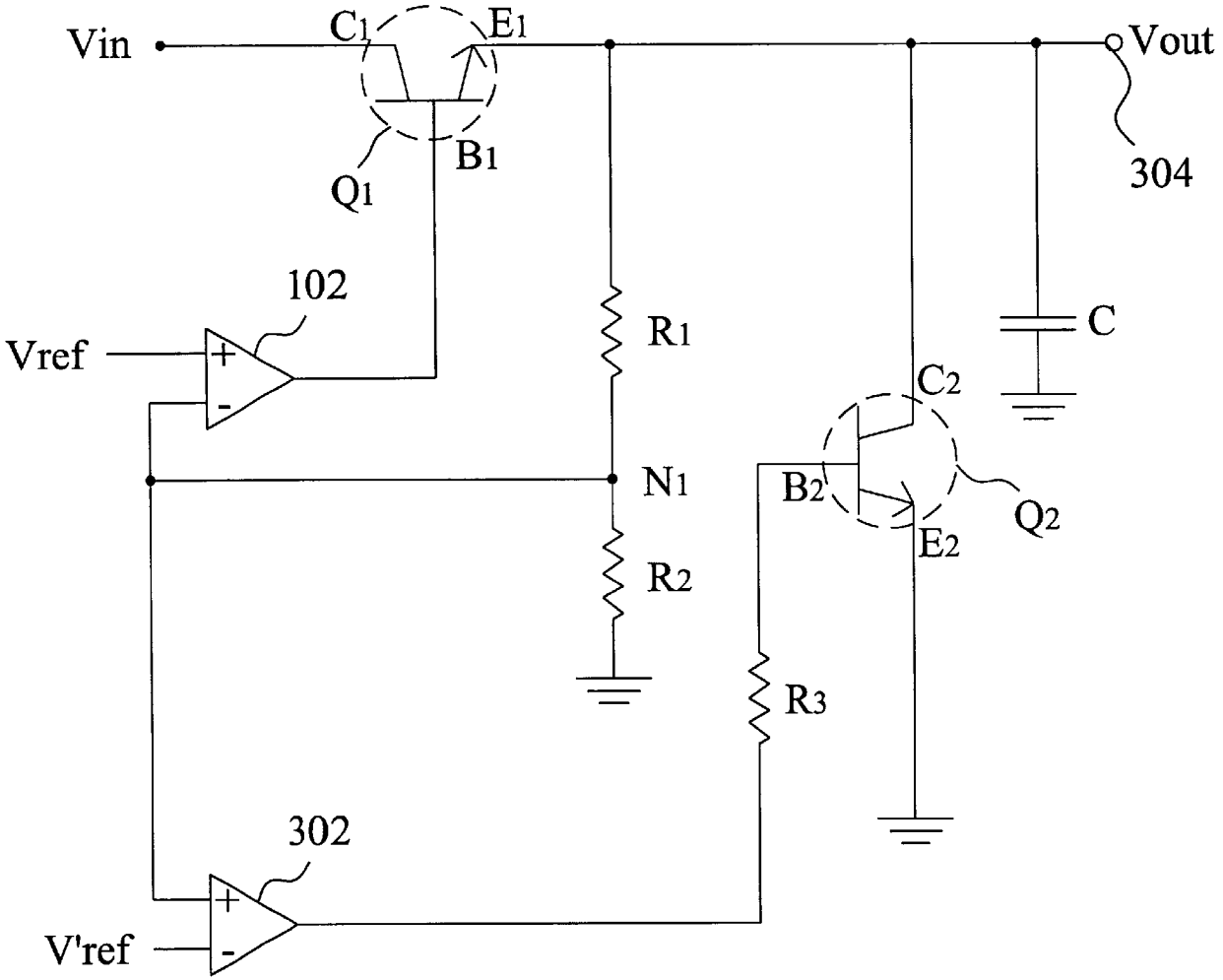
FIG. 3 is a circuit diagram of a linear regulator capable of sinking current in accordance with a preferred embodiment of the invention.

Referring to FIG. 3, it illustrates a linear regulator capable of sinking current according to a preferred embodiment of the invention. Based on the conventional linear regulator, the linear regulator shown in FIG. 3 employs a transistor Q2 and an amplifier 302 for achieving the object of the invention. The collector C2 of the transistor Q2 is coupled to the emitter E1 of the transistor Q1. The emitter E2 of the Q2 is connected to the ground while the base B2 of the Q2 is coupled to the output of the amplifier 302 through a resistor R3. The inverting input terminal of the amplifier 302 receives a reference voltage V'ref, equal to Vref +Va, where Va indicates a positive voltage value. The non-inverting input terminal is coupled to a node N1. The output voltage at the output terminal 304 of the linear regulator is linearly dependant to the voltage VN1 at the node N1, their relationship is as follows.

$$VN1=(R2/(R1+R2))\cdot Vout.$$

When the voltage VN1 at the node N1 exceeds the reference voltage V'ref, the amplifier 302 outputs a positive voltage making the transistor Q2 conduct. In other words, when the value of (R2/(R1+R2))·Vout is greater than the reference voltage V'ref, i.e. if Vout>((R1+R2)/R2)·V'ref, the transistor Q2 conducts. In this case, the transistor Q2 absorbs the current fed from the output terminal Vout, resulting in the capacitance of the capacitor C restricted within the limitation of the system.

The value of Va can be designed according to the allowable maximum of the output voltage Vout. For example, if the allowable maximum output voltage of the system is Vmax, V'ref=(R2/(R1+R2))·Vmax is taken, i.e. Vref+Va=(R2/(R1+R2))·Vmax. Solving for Va results in (R2(R1+R2))·Vmax−Vref.

Figure 4:
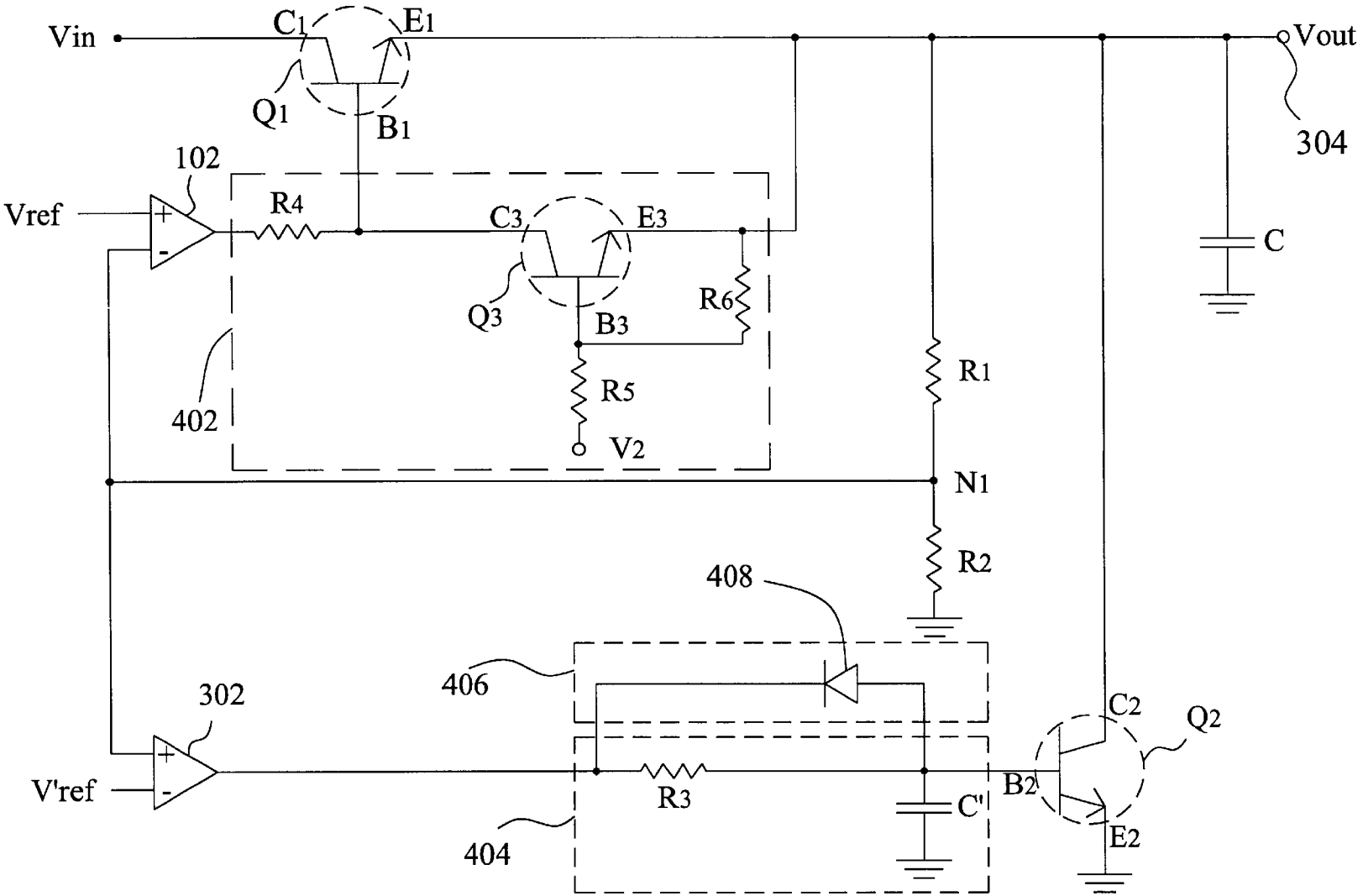
FIG. 4 is a circuit diagram illustrating an improved version of the linear regulator shown in FIG. 3.

For the protection from short circuit and prevention of misuse, improvements can be made on the linear regulator. FIG. 4 shows a circuit diagram illustrating an improved version of the linear regulator shown in FIG. 3. In FIG. 4 the linear regulator further includes a short-circuit protection circuit 402, a delay circuit 404 and an inverting assistance circuit 406. In the short-circuit protection circuit 402, a resistor R4 is coupled between the output terminal of the amplifier 102 and the base B1 of the transistor Q1, where the base B1 is connected to the collector C3 of the transistor Q3. Resistor R5 is connected between the base B3 of the transistor Q3 and a fixed voltage V2 source while resistor R6 is connected between the base B3 and the emitter E3 of the transistor Q3.

Under the normal operation, the transistor Q3 is in the off state. When short circuit occurs at the output terminal of the linear regulator, the output voltage Vout is dropped to zero. Then, the transistor Q3 conducts, absorbing a large amount current from the base B1 of the transistor Q1, reducing the current flowing through the transistor Q1. In this way, the transistor Q1 is protected.

For example, if V2=2.1 V and R5=R6, the transistor Q3 conducts as the output voltage is reduced below 0.7 V. In this case, the input current of the base B1 of the transistor Q1 is reduced, the current that flows into the collector C1 is accordingly reduced. As a result, the purpose of protection for the transistor Q1 is achieved.

On the other hand, in order to prevent the wrong operations from occurring during the initialization of the linear regulator according to the invention, a delay circuit 404 is utilized to make the Q1 conduct before the Q2 does. The delay circuit 404 includes a resistor R3 and a capacitor C'. The resistor R3 is connected between the output terminal of the amplifier 302 and the base B2 of the transistor Q2 while the capacitor C' is connected between the base B2 and the ground. When the amplifier 302 outputs a positive voltage, the transistor Q2 will be conducted after a delay time due to the presence of the capacitor C'. As a result, the wrong operations are prevented.

When the transistor Q2 does not conduct, a diode 408 of the inverting assistance circuit 406 effectively prevents the charges in the base B2 of the transistor Q2, causing the transistor Q2 to cut off rapidly and thus increasing the response speed of the linear regulator.

Figure 1A:
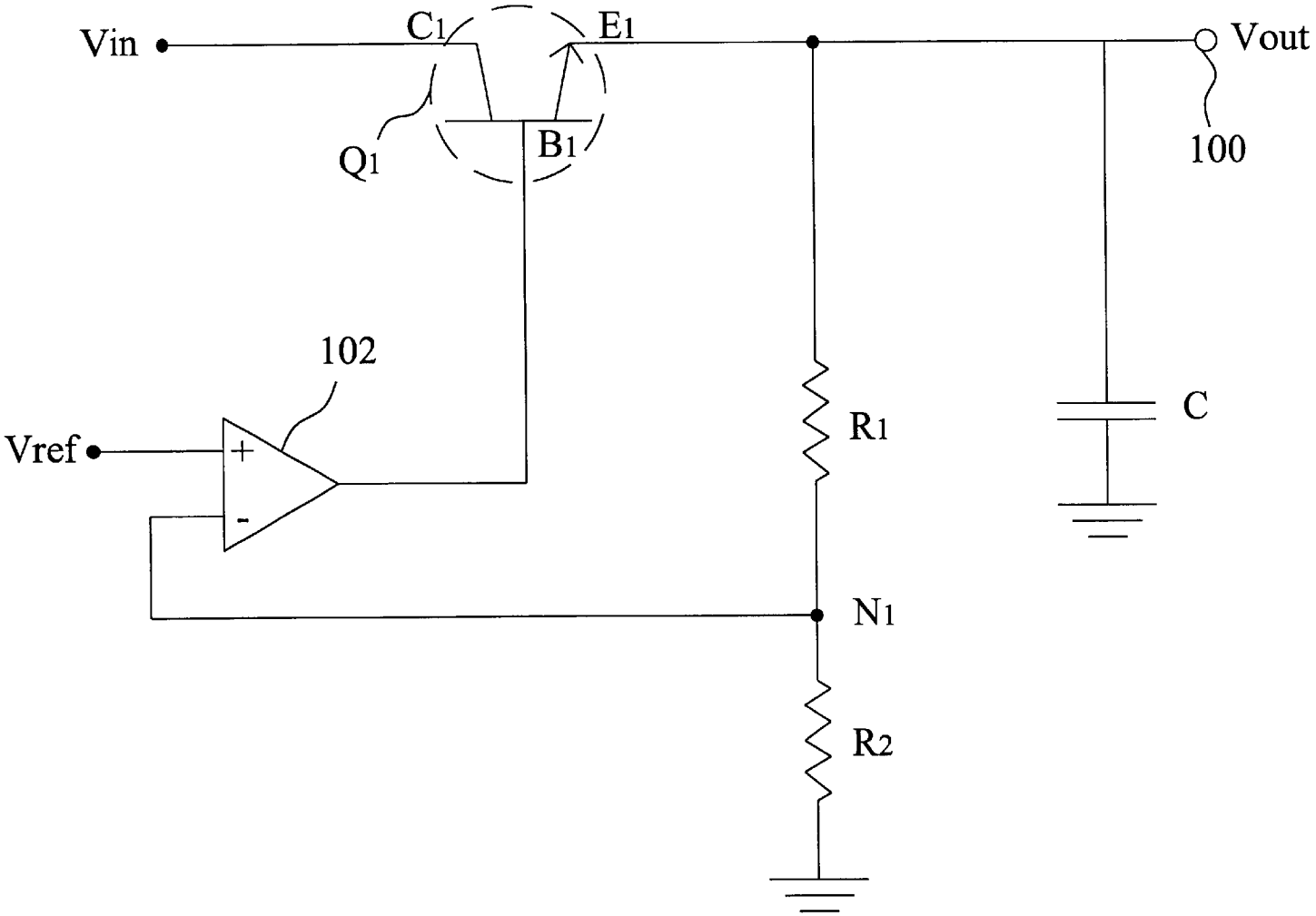
FIG. 1A (PRIOR ART)
FIG. 1A (Prior Art) illustrates a conventional linear regulator.
Figure 1B:
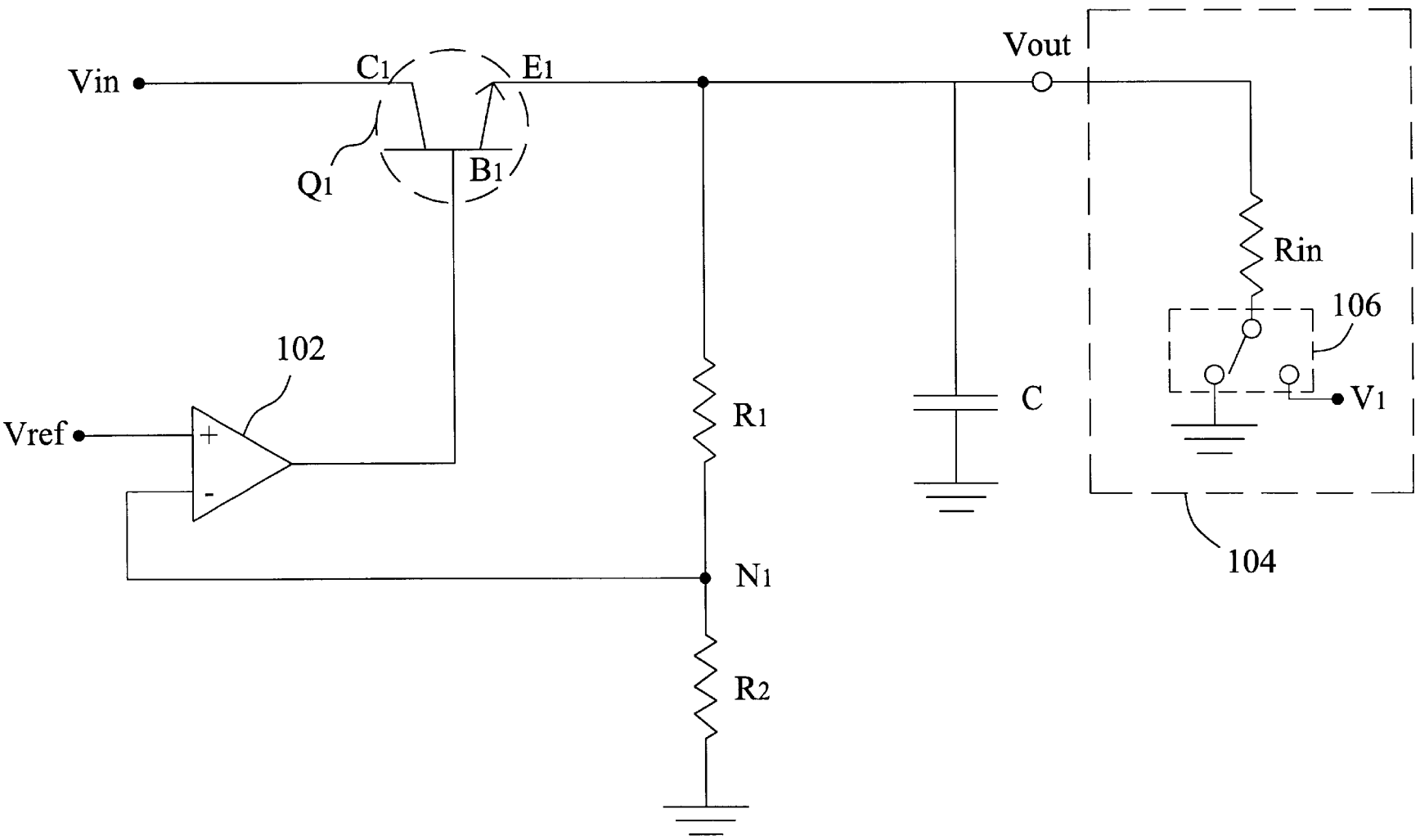
FIG. 1B (PRIOR ART)
FIG. 1B (Prior Art) illustrates the operations of the conventional linear regulator shown in FIG. 1 connecting to the next stage.
Figure 2:
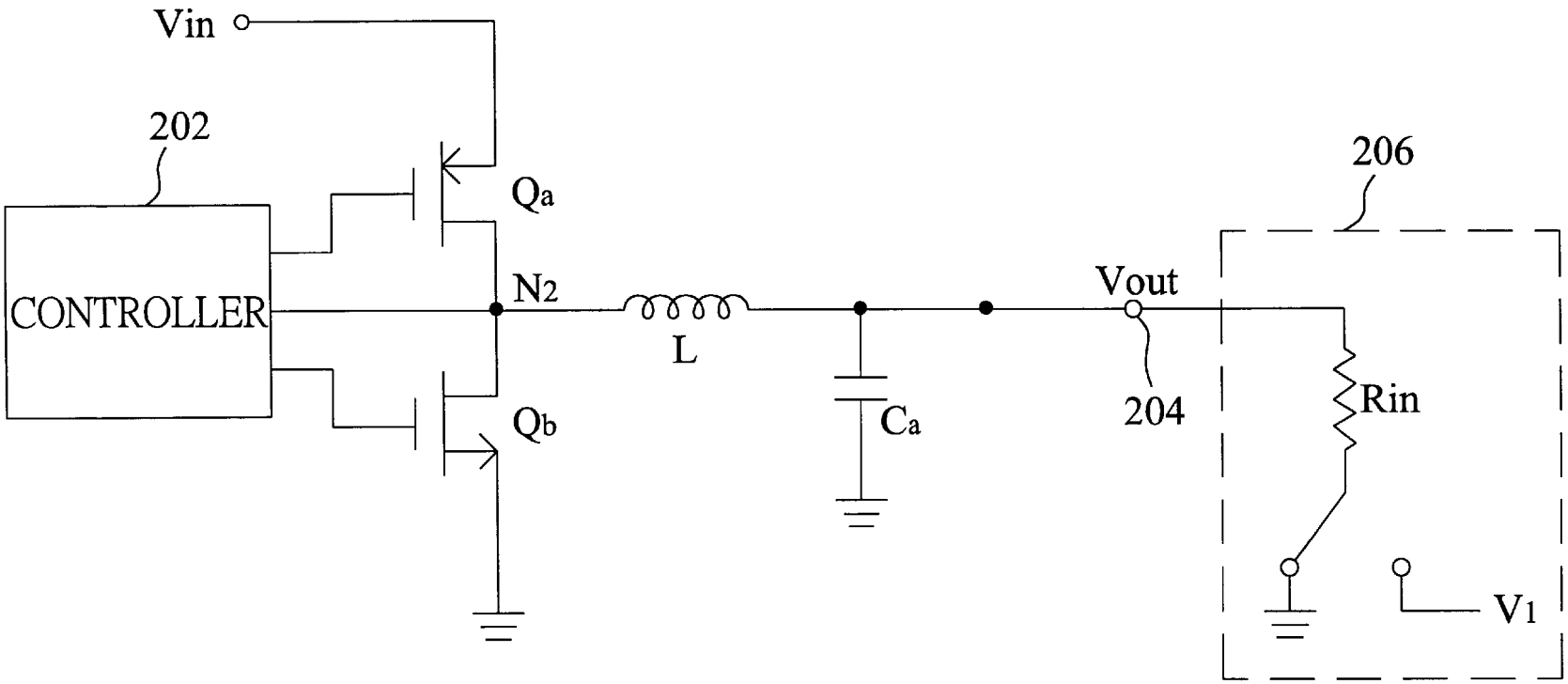
FIG. 2 (PRIOR ART)
FIG. 2 (Prior Art) illustrates the structure and the operations of a conventional linear regulator capable of resolving the feeding current from the next stage.

As disclosed above, the linear regulator which is capable of sinking current is simple in structure so the production cost is low. According to the invention, a simple structure with only a small number of components is employed to resolve the problem of the feeding current from the next stage. The linear regulator according to the invention can be coupled to the double data rate random access memory (DDR RAM) or any other circuit that feeds the previous stage with current. In addition, the invention provides the functions of protection from short circuit and prevention of wrong operations. In practice, the cost of the circuit according to the invention is decrease by 80% as compared with the conventional approach. Moreover, by experiment, when the transistors are switching between the on and off states, the current stability of the circuit structure according to the invention is better than the conventional circuit shown in FIG. 2. Therefore, the linear regulator according to the invention provides a better performance and requires a less production cost, having the advantages over other products.

While the invention has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A linear regulator capable of sinking current, outputting an output voltage at an output terminal of the linear regulator, the output terminal providing a next stage with the output voltage, the next stage feeding the linear regulator with current, the linear regulator comprising:

a first transistor, connected to the output terminal of the linear regulator, for receiving an input voltage;

a first amplifier comprising:

a first non-inverting input terminal for receiving a first reference voltage;

a first inverting input terminal for receiving a first voltage, the first voltage corresponding to the output voltage; and a first output terminal, connected to the first transistor, for controlling the first transistor;

a second transistor connected to the output terminal of the linear regulator; and a second amplifier comprising:

a second non-inverting input terminal for receiving a second voltage, the second voltage corresponding to the output voltage;

a second inverting input terminal for receiving a second reference voltage, the second reference voltage being greater than the first reference voltage; and a second output terminal, connected to the second transistor, for controlling the second transistor, wherein the second transistor conducts and sinks the current from the next stage when the second voltage is greater than the second reference voltage.

2. A linear regulator according to claim 1, wherein the first voltage is linearly dependent on the output voltage.

3. A linear regulator according to claim 1, wherein the second voltage is linearly dependent on the output voltage.

4. A linear regulator according to claim 3, wherein when an allowable maximum of the output voltage is equal to a maximum output voltage value, the second reference voltage is linearly dependent on the maximum output voltage.

5. A linear regulator according to claim 3, further comprising an inverting assistance circuit, the inverting assistance circuit being connected to the second output terminal and the second transistor, the inverting assistance circuit comprising a diode, wherein when the second transistor does not conduct, the diode excludes charges of the second transistor, making the second transistor cut off quickly and so increasing the response speed of the linear regulator.

6. A linear regulator according to claim 1, further comprising a short-circuit protection circuit, the short-circuit protection circuit being connected to the first amplifier, the first transistor, and the output terminal of the linear regulator, the short-circuit protection circuit comprising a third transistor and a bias circuit, wherein when the output terminal of the linear regulator is short-circuited, the third transistor conducts, decreasing the current flowing into the first transistor.

7. A linear regulator according to claim 1, further comprising a delay circuit, the delay circuit being connected to the second output terminal and the second transistor, the delay circuit comprising a resistor and a capacitor, wherein when the second amplifier outputs a positive voltage, the second transistor conducts after a time period elapses due to the delay unit.

8. A linear regulator according to claim 1, wherein the first voltage is equal to the second voltage.

9. A linear regulator according to claim 1, wherein the next stage is a double data rate random access memory (DDR RAM).

10. A linear regulator capable of sinking current, outputting an output voltage at an output terminal of the linear regulator, the output terminal providing a next stage with the output voltage, the next stage being the input stage of a double data rate random access memory (DDR RAM), the linear regulator comprising:

a first transistor, connected to the output terminal of the linear regulator, for receiving an input voltage;

a first amplifier comprising:

a first non-inverting input terminal for receiving a first reference voltage;

a first inverting input terminal for receiving a first voltage, the first voltage corresponding to the output voltage; and a first output terminal, connected to the first transistor, for controlling the first transistor;

a second transistor connected to the output terminal of the linear regulator; and a second amplifier comprising:

a second non-inverting input terminal for receiving a second voltage, the second voltage corresponding to the output voltage;

a second inverting input terminal for receiving a second reference voltage, the second reference voltage being greater than the first reference voltage; and a second output terminal, connected to the second transistor, for controlling the second transistor, wherein the second transistor conducts and sinks the current from the next stage when the second voltage is greater than the second reference voltage.

* * * * *